US010878779B2

(12) United States Patent
Ji et al.

(10) Patent No.: US 10,878,779 B2
(45) Date of Patent: Dec. 29, 2020

(54) DISPLAY PANEL, METHOD OF ESTABLISHING OVERDRIVE LOOKUP TABLE FOR THE DISPLAY PANEL, AND READABLE STORAGE MEDIUM

(71) Applicants: Chongqing HKC Optoelectronics Technology Co., Ltd., Chongqing (CN); HKC Corporation Limited, Guangdong (CN)

(72) Inventors: Feilin Ji, Chongqing (CN); Wei Chen, Chongqing (CN)

(73) Assignees: Chongqing HKC Optoelectronics Technology Co., Ltd., Chongqing (CN); HKC Corporation Limited, Shenzhen (CN)

( * ) Notice: Subject to any disclaimer, the term of this patent is extended or adjusted under 35 U.S.C. 154(b) by 0 days.

(21) Appl. No.: 16/253,198

(22) Filed: Jan. 21, 2019

(65) Prior Publication Data

US 2020/0098334 A1 Mar. 26, 2020

Related U.S. Application Data

(63) Continuation of application No. PCT/CN2018/111350, filed on Oct. 23, 2018.

(30) Foreign Application Priority Data

Sep. 21, 2018 (CN) ..... 2018 1 1111995

(51) Int. Cl.

| | |
|---|---|
| ***G09G 3/36*** | (2006.01) |
| ***G09G 5/10*** | (2006.01) |
| ***G09G 3/20*** | (2006.01) |

(52) U.S. Cl.

CPC ..... *G09G 5/10* (2013.01); *G09G 3/2003* (2013.01); *G09G 3/2074* (2013.01); *G09G 2320/0233* (2013.01); *G09G 2320/0242* (2013.01); *G09G 2320/0252* (2013.01); *G09G 2320/0666* (2013.01)

(58) Field of Classification Search

None

See application file for complete search history.

(56) References Cited

U.S. PATENT DOCUMENTS

| | | | | |
|---|---|---|---|---|
| 2005/0146495 | A1 | 7/2005 | MacKinnon et al. | |
| 2006/0007093 | A1* | 1/2006 | La | G09G 3/3614 345/96 |
| 2008/0238936 | A1* | 10/2008 | Kim | G09G 3/3648 345/618 |
| 2008/0239184 | A1* | 10/2008 | Kim | G09G 3/3696 349/41 |
| 2009/0079714 | A1* | 3/2009 | Shih | G09G 3/2092 345/204 |

(Continued)

FOREIGN PATENT DOCUMENTS

| | | | |
|---|---|---|---|
| CN | 1691121 | A | 11/2005 |
| CN | 101197119 | A | 6/2008 |

(Continued)

*Primary Examiner* — Carl Adams

(57) ABSTRACT

The present disclosure discloses a method of establishing overdrive lookup table for display panel, which could determine the overdrive lookup table of the display panel according to an overdrive lookup table of a target adjustment area after determining the overdrive lookup table of the target adjustment area.

18 Claims, 4 Drawing Sheets

(56) References Cited

U.S. PATENT DOCUMENTS

| | | | | |
|---|---|---|---|---|
| 2011/0221762 | A1 | 9/2011 | Cheng et al. | |
| 2011/0227941 | A1 | 9/2011 | Huang | |
| 2016/0104443 | A1* | 4/2016 | Lee | G09G 3/3677 345/209 |

FOREIGN PATENT DOCUMENTS

| | | | |
|---|---|---|---|
| CN | 101645256 | A | 2/2010 |
| CN | 102637400 | A | 8/2012 |
| CN | 102820015 | A | 12/2012 |
| CN | 103021363 | A | 4/2013 |
| CN | 105355184 | A | 2/2016 |
| CN | 106205545 | A | 12/2016 |
| CN | 108039155 | A | 5/2018 |
| TW | 200929144 | A | 7/2009 |

* cited by examiner

DISPLAY PANEL, METHOD OF ESTABLISHING OVERDRIVE LOOKUP TABLE FOR THE DISPLAY PANEL, AND READABLE STORAGE MEDIUM

CROSS REFERENCE TO RELATED APPLICATIONS

The present application is a Continuation Application of PCT Application No. PCT/CN2018/111350 filed on Oct. 23, 2018, which claims the benefit of Chinese Patent Application No. 201811111995.3, filed on Sep. 21, 2018, which is incorporated herein by reference in its entirety.

TECHNICAL FIELD

The present disclosure relates to the field of display device technology, and more particularly to a display panel, a method of establishing overdrive lookup table for the display panel, and a readable storage medium.

BACKGROUND

Liquid crystal display panels with high definition resolution (namely HD resolution) commonly use a dual gate driving structure, and commonly use a 2-line or 1+2-line polarity driving method. Since liquid crystal molecules need time to respond, usually it takes a period of time for the liquid crystal molecules to move to positions corresponding to the data after being refreshed, under a dual gate driving structure, the charging time would be halved comparing to normal structures, which is prone to lead to: when adjacent uplink and downlink rows are switched, a problem of insufficient charging would occur for different polarities, for example, switching red sub-pixels of the uplink row to yellow sub-pixels causes the yellow sub-pixels to be undercharged, switching blue sub-pixels of the uplink row to red sub-pixels causes the red sub-pixels to be undercharged, and switching yellow sub-pixels of the uplink row to blue sub-pixels causes the blue sub-pixels to be undercharged; thereby bringing about a large difference in brightness and color shift between the distal end area and the central area of the display panel, resulting in the problem of inconsistent uniformity of a display panel image.

Overdrive technology is used to solve the problem of inconsistent uniformity of the display panel image. While overdrive technology is based on a overdrive lookup table. In the prior art, a method for establishing lookup table is an exhaustive verification method, that is, the uplink row's sub-pixel M grayscale is 0, 1, 2, 3, 4 . . . 255, performing exhaustive verification to obtain a grayscale closest to N grayscale to N grayscale brightness as the value in the overdrive lookup table, it needs 256*256=65536 times to adjust one value in the lookup table, then one value in the overdrive lookup table could be debugged completely, if the entire overdrive lookup table needs to be debugged completely, taking the 17*17 overdrive lookup table as an example, it requires performing exhaustive verification of 18,939,904 times, which consumes huge amount of labor and material resources, resulting in a high cost for establishing the overdrive lookup table.

SUMMARY

The present disclosure is to provide a display panel, a method of establishing overdrive lookup table for the display panel, and a readable storage medium, which aims to solve the problem of the high cost for establishing overdrive lookup table.

In order to achieve the above aim, the present disclosure provides a method of establishing overdrive lookup table, which includes:

Determining a target reference area and a target adjustment area in the display panel;

Measuring a reference color coordinate matrix corresponding to the target reference area, and an adjustment color coordinate matrix corresponding to the target adjustment area;

Determining an overdrive lookup table corresponding to the target adjustment area according to the adjustment color coordinate matrix and the reference color coordinate matrix; and Establishing an overdrive lookup table corresponding to the display panel according to the overdrive lookup table corresponding to the target adjustment area.

Optionally, the operation of measuring the reference color coordinate matrix corresponding to the target reference area, and the adjustment color coordinate matrix corresponding to the target adjustment area includes:

Illuminating adjacent sub-pixels connected with data line of each preset serial number in the target reference area in sequence according to different grayscale values, so as to measure color coordinate corresponding to the target reference area, to obtain the reference color coordinate matrix, wherein, the preset serial numbers are 3n+1, 3n+2, or 3n+3, n is an integer; and Illuminating adjacent sub-pixels connected with data line of each preset serial number in the target adjustment area in sequence according to different grayscale values, so as to measure color coordinates corresponding to the target adjustment area, to obtain the adjustment color coordinate matrix.

Optionally, the operation of determining the overdrive lookup table corresponding to the target adjustment area according to the adjustment color coordinate matrix and the reference color coordinate matrix includes:

Selecting a target reference color coordinate in the reference color coordinate matrix in sequence;

Obtaining a first former illuminating grayscale value and a first latter illuminating grayscale value of the target reference color coordinate at each time the target reference color coordinate is extracted;

Obtaining a target adjustment color coordinate matching with the first former illuminating grayscale value and the target reference color coordinate in the adjustment color coordinate matrix, wherein, the target adjustment color coordinate is in the area corresponding to the first former illuminating grayscale value and matches with the target reference color coordinate;

Calculating a grayscale difference value between the first latter illuminating grayscale value and a second latter illuminating grayscale value corresponding to the target adjustment color coordinate;

Determining a position of each grayscale difference value in a preset table according to the first former illuminating grayscale value and the first latter illuminating grayscale value corresponding to each target reference color coordinate, so as to fill each grayscale difference value in the preset table, and obtain the overdrive lookup table corresponding to the target adjustment area.

Optionally, the operation of establishing the overdrive lookup table corresponding to the display panel according to the overdrive lookup table corresponding to the target adjustment area includes:

Obtaining scale factors corresponding to each of the other areas except the target adjustment area, so as to determine the overdrive lookup table of the display panel according to the overdrive lookup table corresponding to the target adjustment area and each scale factor.

Optionally, the operation of obtaining the scale factor corresponding to each of the other areas except the target adjustment area, so as to determine the overdrive lookup table of the display panel according to the overdrive lookup table corresponding to the target adjustment area and each scale factor, includes:

Determining the scale factors corresponding to each of the other areas except the target adjustment area on the display panel;

Multiplying each grayscale difference value in the overdrive lookup table of the target adjustment area by the scale factor corresponding to each of the other areas to obtain the overdrive lookup table corresponding to each of the other areas; and Establishing the overdrive lookup table of the display panel according to the overdrive lookup table of the target adjustment area and the overdrive lookup table corresponding to each of the other areas.

Optionally, the operation of obtaining the target adjustment color coordinate matching with the first former illuminating grayscale value and the target reference color coordinate in the adjustment color coordinate matrix includes:

determining the adjustment color coordinate in the adjustment color coordinate matrix closest to the color of the target reference color coordinate, as the target adjustment color coordinate matching with the target reference color coordinate.

Optionally, the number of the first former illuminating grayscale values is 17, the number of the first latter illuminating grayscale values is 17, the number of the second former illuminating grayscale values is 17, and the number of second latter illuminating grayscale values is 256.

Optionally, subsequent to the operation of establishing the overdrive lookup table corresponding to the display panel, the method further includes:

increasing or decreasing driving voltage corresponding to each sub-pixel in the display panel according to the overdrive lookup table of the display panel, allowing the image displayed by the display panel to be uniform.

Optionally, the closer the distance between the area on the display panel and gate integrated circuit, the smaller the scale factor corresponding to the area.

Optionally, the target reference area is a central area of the display panel, and the target reference area corresponds to a scale factor of zero.

Optionally, the overdrive lookup table of the display panel includes an overdrive lookup table corresponding to first illuminating red sub-pixels and then illuminating yellow sub-pixels, an overdrive lookup table corresponding to first illuminating blue sub-pixels and then illuminating red sub-pixels, and an overdrive lookup table corresponding to first illuminating yellow sub-pixels and then illuminating blue sub-pixels.

Optionally, the overdrive lookup table of the display panel is a 17*17 lookup table.

Optionally, thin film transistor array substrate in the display panel has a dual gate driving structure, and data lines of the thin film transistor array substrate are connected with adjacent sub-pixels in the same row.

In order to achieve the above aim, the present disclosure also provides a display panel, the display panel includes at least one processor, and a memory, wherein, The memory stores computer executable instructions that could be executed by the at least one processor, when the computer executable instructions are executed by the at least one processor, the following steps are performed by one processor:

Determining a target reference area and a target adjustment area in the display panel;

Measuring a reference color coordinate matrix corresponding to the target reference area, and an adjustment color coordinate matrix corresponding to the target adjustment area;

Determining an overdrive lookup table corresponding to the target adjustment area according to the adjustment color coordinate matrix and the reference color coordinate matrix; and Establishing an overdrive lookup table corresponding to the display panel according to the overdrive lookup table corresponding to the target adjustment area.

Optionally, when the computer executable instructions are executed by the at least one processor, the following steps are performed by one processor:

Illuminating adjacent sub-pixels connected with data line of each preset serial number in the target reference area in sequence according to different grayscale values, so as to measure color coordinate corresponding to the target reference area, obtaining the reference color coordinate matrix, wherein, the preset serial numbers are 3n+1, 3n+2, or 3n+3, n is an integer; and Illuminating adjacent sub-pixels connected with data line of each preset serial number in the target adjustment area in sequence according to different grayscale values, so as to measure color coordinates corresponding to the target adjustment area, to obtain the adjustment color coordinate matrix.

Optionally, when the computer executable instructions are executed by the at least one processor, the following steps are performed by one processor:

Selecting a target reference color coordinate in the reference color coordinate matrix in sequence;

Obtaining a first former illuminating grayscale value and a first latter illuminating grayscale value of the target reference color coordinate at each time the target reference color coordinate is extracted;

Obtaining a target adjustment color coordinate matching with the first former illuminating grayscale value and the target reference color coordinate in the adjustment color coordinate matrix, wherein, the target adjustment color coordinate is in the area corresponding to the first former illuminating grayscale value and matches with the target reference color coordinate;

Calculating a grayscale difference value between the first latter illuminating grayscale value and a second latter illuminating grayscale value corresponding to the target adjustment color coordinate;

Determining a position of each grayscale difference value in a preset table according to the first former illuminating grayscale value and the first latter illuminating grayscale value corresponding to each target reference color coordinate, so as to fill each grayscale difference value in the preset table, and obtain the overdrive lookup table corresponding to the target adjustment area.

Optionally, when the computer executable instructions are executed by the at least one processor, the following steps are performed by one processor:

Obtaining scale factors corresponding to each of the other areas except the target adjustment area, so as to determine the overdrive lookup table of the display panel according to the overdrive lookup table corresponding to the target adjustment area and each scale factor.

Optionally, when the computer executable instructions are executed by the at least one processor, the following steps are performed by one processor:

Determining the scale factors corresponding to each of the other areas except the target adjustment area on the display panel;

Multiplying each grayscale difference value in the overdrive lookup table of the target adjustment area by the scale factor corresponding to each of the other areas to obtain the overdrive lookup table corresponding to each of the other areas; and Establishing the overdrive lookup table of the display panel according to the overdrive lookup table of the target adjustment area and the overdrive lookup table corresponding to each of the other areas.

Optionally, when the computer executable instructions are executed by the at least one processor, the following steps are performed by one processor:

Determining the adjustment color coordinate in the adjustment color coordinate matrix closest to the color of the target reference color coordinate, as the target adjustment color coordinate matching with the target reference color coordinate.

In order to achieve the above aim, the present disclosure also provides a readable storage medium, which stores computer executable instructions that could be executed by at least one processor, when the computer executable instructions are executed by the at least one processor, the following steps are performed by one processor:

Determining a target reference area and a target adjustment area in the display panel;

A determining module, correspond to measuring illuminated adjacent sub-pixels in the target reference area and the target adjustment area respectively, configured to determine the target reference area and the target adjustment area in the display panel;

Measuring a reference color coordinate matrix corresponding to the target reference area, and an adjustment color coordinate matrix corresponding to the target adjustment area;

Determining an overdrive lookup table corresponding to the target adjustment area according to the adjustment color coordinate matrix and the reference color coordinate matrix; and Establishing an overdrive lookup table corresponding to the display panel according to the overdrive lookup table corresponding to the target adjustment area.

The present disclosure provides a display panel, a method of establishing overdrive lookup table for the display panel, and a readable storage medium, a target reference area and a target adjustment area in the display panel are determined, so as to measure a reference color coordinate matrix corresponding to the target reference area, and an adjustment color coordinate matrix corresponding to the target adjustment area, thus an overdrive lookup table corresponding to the target adjustment area is determined according to the adjustment color coordinate matrix and the reference color coordinate matrix, and then an overdrive lookup table corresponding to the display panel is established according to the overdrive lookup table corresponding to the target adjustment area; since the overdrive lookup table corresponding to the entire display panel could be established as long as the overdrive lookup table corresponding to the target adjustment area is determined, which greatly reduces the time for establishing overdrive lookup table of display panel, saves labor and material resources, and decreases the cost for establishing overdrive lookup table of the display panel.

BRIEF DESCRIPTION OF THE ACCOMPANYING DRAWINGS

The realizing of the aim, functional characteristics, advantages of the present disclosure are further described in detail with reference to the accompanying drawings and the embodiments.

DETAILED DESCRIPTION OF ILLUSTRATIVE EMBODIMENTS

It is to be understood that, the specific embodiments described herein portrays merely some illustrative embodiments of the present disclosure, and are not intended to limit the patentable scope of the present disclosure.

The main solution of the present disclosure is: determining a target reference area and a target adjustment area in the display panel; measuring a reference color coordinate matrix corresponding to the target reference area, and an adjustment color coordinate matrix corresponding to the target adjustment area; determining an overdrive lookup table corresponding to the target adjustment area according to the adjustment color coordinate matrix and the reference color coordinate matrix; and establishing an overdrive lookup table corresponding to the display panel according to the overdrive lookup table corresponding to the target adjustment area.

Since the overdrive lookup table corresponding to the entire display panel could be established as long as the overdrive lookup table corresponding to the target adjustment area is determined, which greatly reduces the time for establishing overdrive lookup table of the display panel, saves labor and material resources, and decreases the cost for establishing overdrive lookup table of the display panel.

Figure 1:
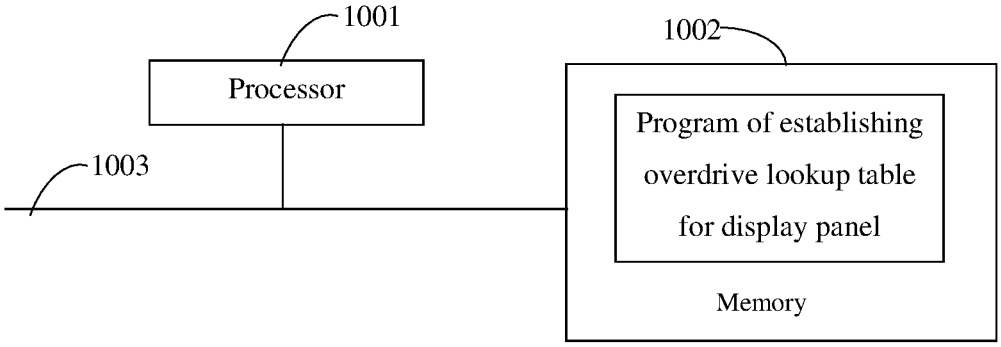
FIG. 1 is a block diagram illustrating an embodiment of a hardware structure of display panel.

As an implementation, a display panel could be as shown in FIG. 1.

The solution of this embodiment of the present disclosure relates to the display panel. The display panel includes a processor 1001, such as a CPU, a memory 1002, and a communication bus 1003. The communication bus 1003 is configured to implement connection communication between these components.

The memory 1002 may be a high speed RAM memory or a non-volatile memory such as a magnetic disk memory. As shown in FIG. 1, the memory 1003 as a computer storage medium may include a program of establishing overdrive lookup table of the display panel; and the processor 1001 could be configured to invoke the program of establishing overdrive lookup table of the display panel stored in the memory 1002, and perform the following operations:

Determining a target reference area and a target adjustment area in the display panel;

Measuring a reference color coordinate matrix corresponding to the target reference area, and an adjustment color coordinate matrix corresponding to the target adjustment area;

Determining an overdrive lookup table corresponding to the target adjustment area according to the adjustment color coordinate matrix and the reference color coordinate matrix; and Establishing an overdrive lookup table corresponding to the display panel according to the overdrive lookup table corresponding to the target adjustment area.

Further, the processor 1001 could be configured to invoke the program of establishing overdrive lookup table of the display panel stored in the memory 1002, and perform the following operations:

Illuminating adjacent sub-pixels connected with data line of each preset serial number in the target reference area in sequence according to different grayscale values, so as to measure color coordinate corresponding to the target reference area, to obtain the reference color coordinate matrix, wherein, the preset serial numbers are 3n+1, 3n+2, or 3n+3, n is an integer; and Illuminating adjacent sub-pixels connected with data line of each preset serial number in the target adjustment area in sequence according to different grayscale values, so as to measure color coordinates corresponding to the target adjustment area, to obtain the adjustment color coordinate matrix.

Further, the processor 1001 could be configured to invoke the program of establishing overdrive lookup table of the display panel stored in the memory 1002, and perform the following operations:

Selecting a target reference color coordinate in the reference color coordinate matrix in sequence;

Obtaining a first former illuminating grayscale value and a first latter illuminating grayscale value of the target reference color coordinate at each time the target reference color coordinate is extracted;

Obtaining a target adjustment color coordinate matching with the first former illuminating grayscale value and the target reference color coordinate in the adjustment color coordinate matrix, wherein, the target adjustment color coordinate is in the area corresponding to the first former illuminating grayscale value and matches with the target reference color coordinate;

Calculating a grayscale difference value between the first latter illuminating grayscale value and a second latter illuminating grayscale value corresponding to the target adjustment color coordinate;

Determining a position of each grayscale difference value in a preset table according to the first former illuminating grayscale value and the first latter illuminating grayscale value corresponding to each target reference color coordinate, so as to fill each grayscale difference value in the preset table, and obtain the overdrive lookup table corresponding to the target adjustment area.

Further, the processor 1001 could be configured to invoke the program of establishing overdrive lookup table of the display panel stored in the memory 1002, and perform the following operations:

Determining the scale factors corresponding to each of the other areas except the target adjustment area on the display panel;

Multiplying each grayscale difference value in the overdrive lookup table of the target adjustment area by the scale factor corresponding to each of the other areas to obtain the overdrive lookup table corresponding to each of the other areas; and Establishing the overdrive lookup table of the display panel according to the overdrive lookup table of the target adjustment area and the overdrive lookup table corresponding to each of the other areas.

Further, the processor 1001 could be configured to invoke the program of establishing overdrive lookup table of the display panel stored in the memory 1002, and perform the following operations:

The closer the distance between the area on the display panel and gate integrated circuit, the smaller the scale factor corresponding to the area.

Further, the processor 1001 could be configured to invoke the program of establishing overdrive lookup table of the display panel stored in the memory 1002, and perform the following operations:

The target reference area is a central area of the display panel, and the target reference area corresponds to a scale factor of zero.

Further, the processor 1001 could be configured to invoke the program of establishing overdrive lookup table of the display panel stored in the memory 1002, and perform the following operations:

The overdrive lookup table of the display panel includes an overdrive lookup table corresponding to first illuminating R sub-pixels and then illuminating G sub-pixels, an overdrive lookup table corresponding to first illuminating B sub-pixels and then illuminating R sub-pixels, and an overdrive lookup table corresponding to first illuminating G sub-pixels and then illuminating B sub-pixels.

According to the above solution in this embodiment, the target reference area and the target adjustment area in the display panel are determined, so as to measure the reference color coordinate matrix corresponding to the target reference area, and the adjustment color coordinate matrix corresponding to the target adjustment area, thus the overdrive lookup table corresponding to the target adjustment area is determined according to the adjustment color coordinate matrix and the reference color coordinate matrix, and then the overdrive lookup table corresponding to the display panel is established according to the overdrive lookup table corresponding to the target adjustment area; since the overdrive lookup table corresponding to the entire display panel could be established as long as the overdrive lookup table corresponding to the target adjustment area is determined, which greatly reduces the time for establishing overdrive lookup table of the display panel, saves labor and material resources, and decreases the cost of establishing overdrive lookup table of the display panel.

Based on the above hardware architecture, an embodiment of a method of establishing overdrive lookup table for display panel is proposed in this present disclosure.

Figure 2:
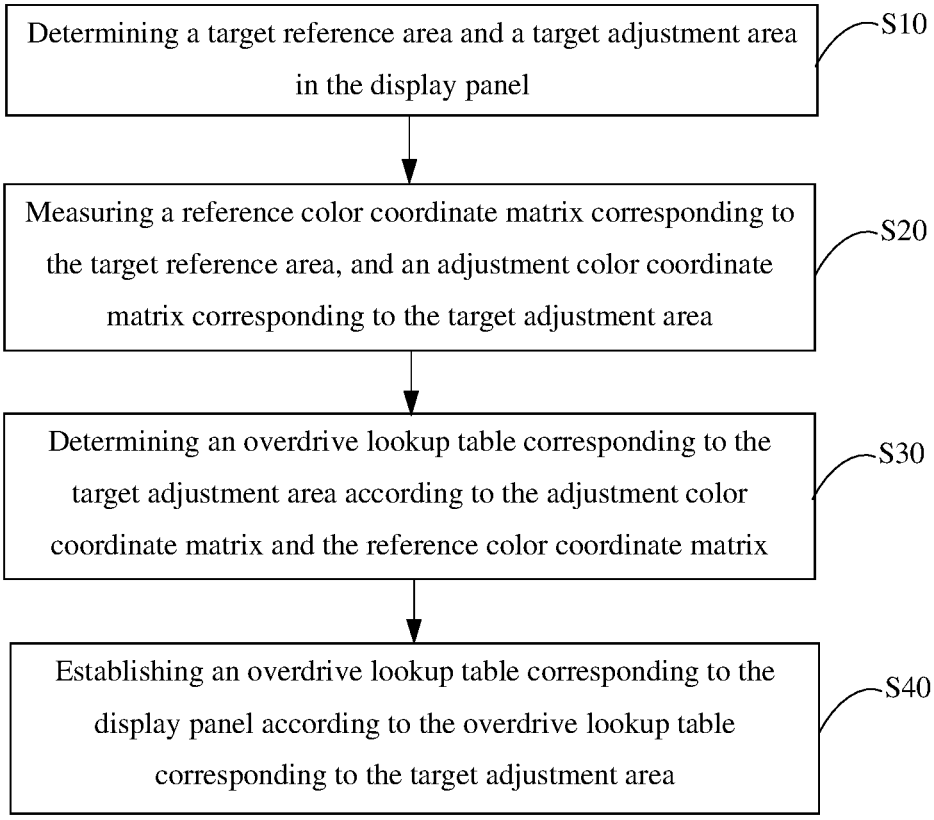
FIG. 2 is a flowchart illustrating an embodiment of a method of establishing overdrive lookup table for display panel according to the present disclosure.

Referring to FIG. 2, FIG. 2 is a flowchart illustrating a first embodiment of the method of establishing overdrive lookup table for display panel according to the present disclosure, the method includes the following steps:

S10, determining a target reference area and a target adjustment area in the display panel;

In the present disclosure, thin film transistor array substrate (TFT array substrate) in the display panel adopts a dual gate driving structure, and adopts a 2line or 2line+1 polarity driving method, that is, a data line is connected with adjacent sub-pixels in the same row. The structure of the TFT array substrate is prone to causing that when adjacent sub-pixels connected with the same data line switch charging, and opposite polarity is charged, the latter illuminating pixels are insufficiently charged, that is, prone to bringing up the situations that 3n+1 G sub-pixels are insufficiently charged(R sub-pixels are switched to G sub-pixels for charging), 3n+2 B sub-pixels are insufficiently charged(G sub-pixels are switched to B sub-pixels for charging), and 3n+3 R sub-pixels are insufficiently charged(B sub-pixels are switched to R sub-pixels for charging), of which n is a positive number, and is an integer. Based on this, overdrive technology is used for undercharged sub-pixels, while the overdrive technology is based on overdrive lookup table, and the display could increase or decrease driving voltage for the undercharged sub-pixels according to the overdrive lookup table, so that the display image of the display panel is uniform.

The basis for the establishment of overdrive lookup table is that the display image of the display panel is uniform, the display panel could be divided into multiple areas, and the target reference area is selected from the multiple areas, so that the optical characteristics of other areas and the target reference area are consistent. It should be noted that, in the present disclosure, the further the distance between each area of the display panel and the gate integrated circuit, the more serious the sub-pixel charging situation is, while the optical characteristics corresponding to each area caused by insufficient charging have certain regularity, thus the target adjustment area could be determined in each area (excluding the target reference area), after determining the overdrive lookup table of target adjustment, the overdrive lookup table corresponding to each of other areas could be obtained according to the regularity of optical characteristics, thereby the overdrive lookup table corresponding to the display panel is established. Therefore, when it is necessary to establish the overdrive lookup table of the display panel, the target reference area and the target adjustment area are determined on the display panel, and the target reference area may be any area on the display panel, preferably an area corresponding to the center position of the display panel.

Figure 3:
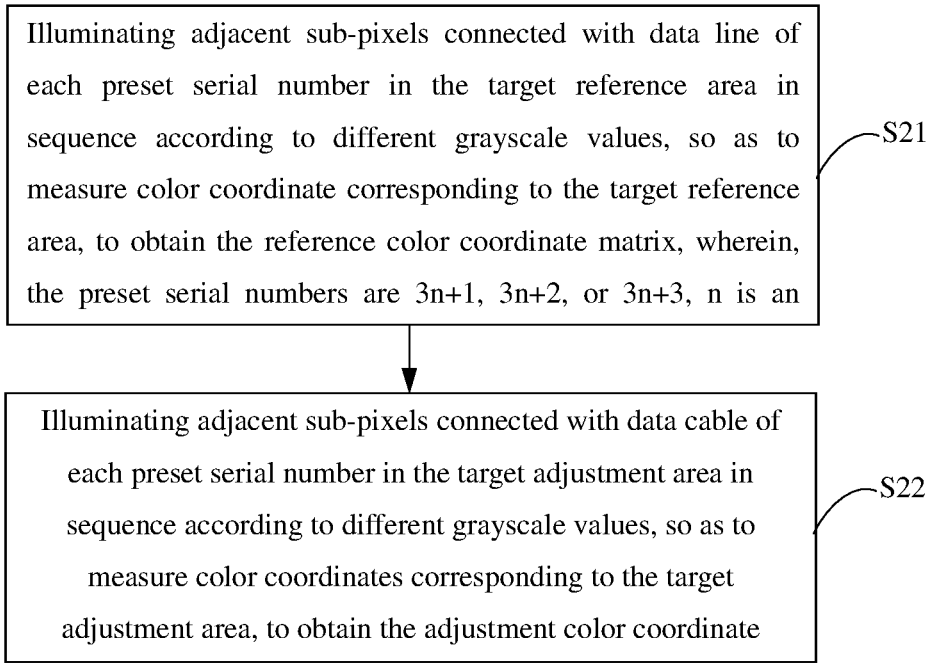
FIG. 3 is a detailed flowchart illustrating S20 in FIG. 2.

S20, measuring a reference color coordinate matrix corresponding to the target reference area, and an adjustment color coordinate matrix corresponding to the target adjustment area;

The display panel could be externally connected with an optical device, and the reference color coordinate matrix corresponding to the target reference area and the adjustment color coordinate matrix corresponding to the target adjustment area are measured by the optical device, specifically, referring to FIG. 3, S20 includes:

S21, illuminating adjacent sub-pixels connected with data line of each preset serial number in the target reference area in sequence according to different grayscale values, so as to measure color coordinate corresponding to the target reference area, to obtain the reference color coordinate matrix, wherein, the preset serial numbers are 3n+1, 3n+2, or 3n+3, n is an integer; and S22, illuminating adjacent sub-pixels connected with data line of each preset serial number in the target adjustment area in sequence according to different grayscale values, so as to measure color coordinates corresponding to the target adjustment area, to obtain the adjustment color coordinate matrix.

The display panel illuminates the adjacent sub-pixels connected with the preset serial number in the target reference area, so that the optical device measures the color coordinate corresponding to the target reference area, the preset serial numbers are 3n+1, 3n+2, or 3n+3, that is, the display panel illuminates all R-G sub-pixels, G-B sub-pixels or B-R sub-pixels in the target reference area; taking the R-G sub-pixels as an example, first the display panel illuminates the R sub-pixels, then illuminates the G sub-pixels, and the former illuminating greyscale values and latter illuminating grayscale values would be constantly changed, so as to measure the different color coordinates of the target reference area, thereby obtaining the reference color coordinate matrix. Taking a 17*17 lookup table as an example, the former illuminating R sub-pixels and the latter illuminating G sub-pixels could be configured with greyscale values according to the table bellow in sequence:

TABLE 1

| | | | | | | | | | | | | | | | | |
|---|---|---|---|---|---|---|---|---|---|---|---|---|---|---|---|---|
| 255 | | | | | | | | | | | | | | | | |
| 240 | | | | | | | | | | | | | | | | |
| 224 | | | | | | | | | | | | | | | | |
| 208 | | | | | | | | | | | | | | | | |
| 192 | | | | | | | | | | | | | | | | |
| 176 | | | | | | | | | | | | | | | | |
| 160 | | | | | | | | | | | | | | | | |
| 144 | | | | | | | | | | | | | | | | |
| 128 | | | | | | | | | | | | | | | | |
| 112 | | | | | | | | | | | | | | | | |
| 96 | | | | | | | | | | | | | | | | |
| 80 | | | | | | | | | | | | | | | | |
| 64 | | | | | | | | | | | | | | | | |
| 48 | | | | | | | | | | | | | | | | |
| 32 | | | | | | | | | | | | | | | | |
| 16 | | | | | | | | | | | | | | | | |
| 0 | | | | | | | | | | | | | | | | |
| G | | | | | | | | | | | | | | | | |
| | | | | | | | | | R | | | | | | | |
| | 0 | 16 | 32 | 48 | 64 | 80 | 96 | 112 | 128 | 144 | 160 | 176 | 192 | 208 | 224 | 240 | 255 |

The R sub-pixels and the G sub-pixels are configured with different grayscale values in the display panel sequentially according to the above table, thereby obtaining a plurality of color coordinates in the target reference area, and the plurality of color coordinates constitute the reference color coordinate matrix (filling the color coordinates into corresponding cells, that is the reference color coordinate matrix).

The adjustment color coordinate matrix could be obtained according to generation principle of the reference color coordinate matrix in the display panel, other than the target reference color area, the grayscale value of the latter illuminating sub-pixels of the target adjustment area varies from 0 to 255, that is, it needs to configure 256 grayscale values for the latter illuminating sub-pixels of the target adjustment area (17 grayscale values are configured for the latter illuminating sub-pixels of the target reference area).

Figure 4:
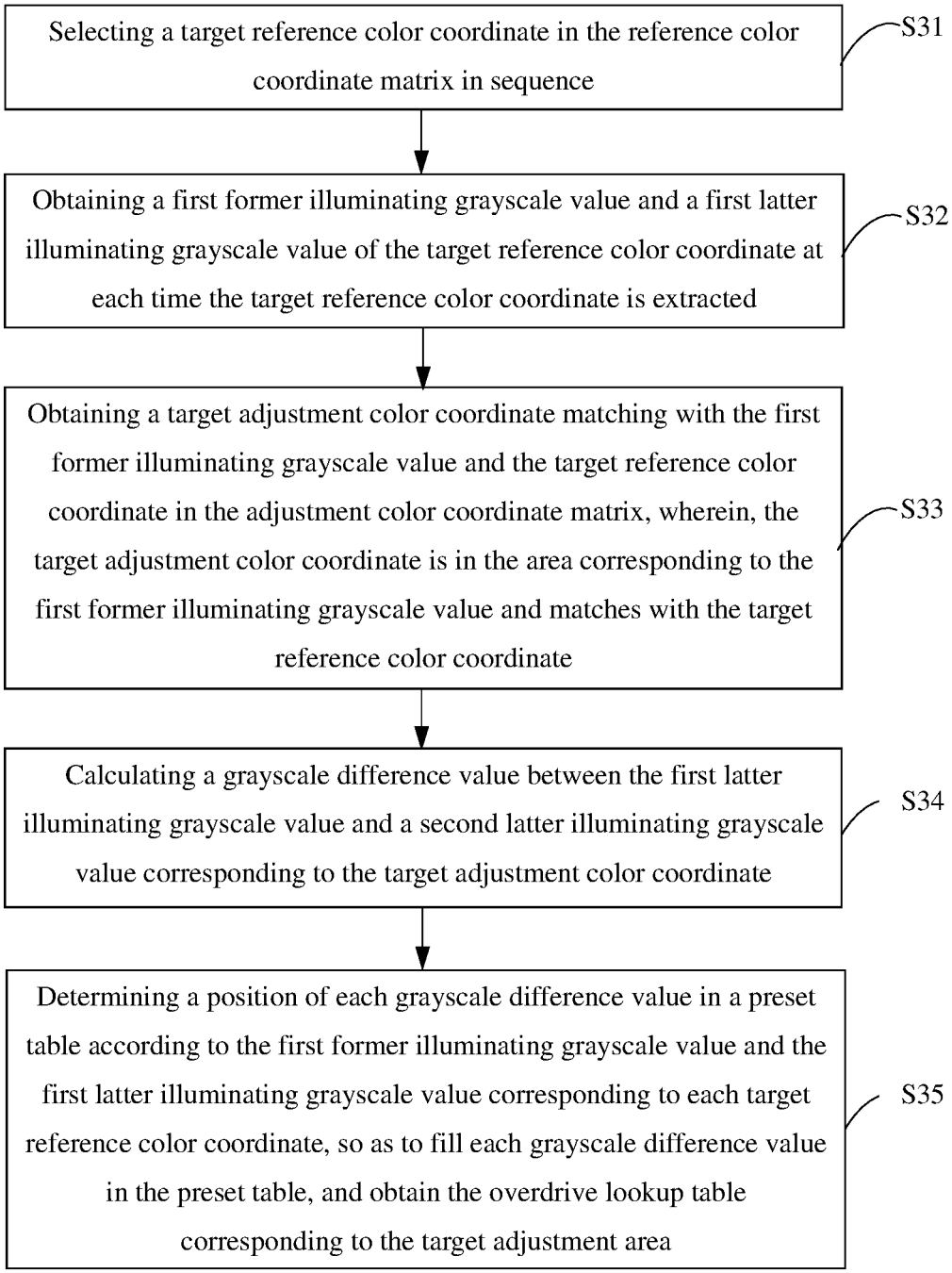
FIG. 4 is a detailed flowchart illustrating S30 in FIG. 2.

S30, determining an overdrive lookup table corresponding to the target adjustment area according to the adjustment color coordinate matrix and the reference color coordinate matrix;

After obtaining the target adjustment color coordinate matrix and adjustment color coordinate matrix, the display panel could determine the overdrive lookup table corresponding to the target adjustment area, specifically, referring to FIG. 4, S30 includes:

S31, selecting a target reference color coordinate in the reference color coordinate matrix in sequence;

S32, obtaining a first former illuminating grayscale value and a first latter illuminating grayscale value of the target reference color coordinate at each time the target reference color coordinate is extracted;

S33, obtaining a target adjustment color coordinate matching with the first former illuminating grayscale value and the target reference color coordinate in the adjustment color coordinate matrix, wherein, the target adjustment color coordinate is in the area corresponding to the first former illuminating grayscale value and matches with the target reference color coordinate;

S34, calculating a grayscale difference value between the first latter illuminating grayscale value and a second latter illuminating grayscale value corresponding to the target adjustment color coordinate;

S35, determining a position of each grayscale difference value in a preset table according to the first former illuminating grayscale value and the first latter illuminating grayscale value corresponding to each target reference color coordinate, so as to fill each grayscale difference value in the preset table, and obtain the overdrive lookup table corresponding to the target adjustment area.

The display panel sequentially takes each color coordinate in the reference color coordinate matrix as the target reference color coordinate, after each time the target color coordinate is selected, the first former illuminating grayscale value and the first latter illuminating grayscale value corresponding to the color coordinate are obtained, and the first former illuminating grayscale value is the grayscale corresponding to the former illuminating sub-pixel of adjacent sub-pixels connected with same data line in the target display area, the latter illuminating grayscale value is the grayscale corresponding to the other sub-pixel of the adjacent sub-pixels.

Then, the display panel determines the adjustment color coordinate matching with the target reference color coordinate in the target adjustment color coordinate matrix, and the second former illuminating grayscale value of the target adjustment color coordinate is the same with the first former illuminating grayscale value of the target reference color coordinate; the process of determining the adjustment color coordinate matching with the target reference color coordinate in the target adjustment color coordinate matrix is as follows:

1. selecting each adjustment color coordinate in the target adjustment color coordinate matrix, the second former illuminating grayscale value of each adjustment color coordinate is equal to the first former illuminating grayscale value corresponding to the target reference color coordinate;

2. determining the adjustment color coordinate closest to the color of the target reference color coordinate, the adjustment color coordinate is the target adjustment color coordinate, closest also means that the colors of the two are the same, that is, the target adjustment color coordinate is equal to the target adjustment color coordinate.

After determining the target adjustment color coordinate corresponding to the target reference color coordinate, calculate the grayscale difference value between the second latter illuminating grayscale value corresponding to the target adjustment color coordinate and the first latter illuminating grayscale value;

Fill the grayscale difference value into the table corresponding to the first former illuminating grayscale value and the first latter illuminating grayscale value, and the table is the above table, that is, the preset table. After the preset table is filled with grayscale differences, the table is the overdrive lookup table corresponding to the target adjustment area.

S40, establishing an overdrive lookup table corresponding to the display panel according to the overdrive lookup table corresponding to the target adjustment area.

Figure 5:
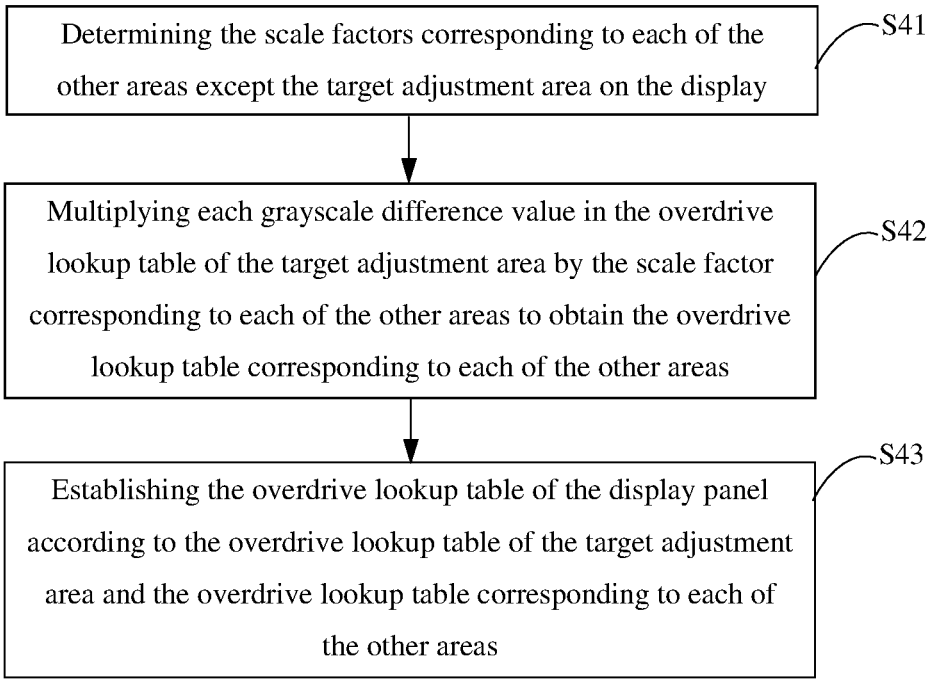
FIG. 5 is a detailed flowchart illustrating S40 in FIG. 2.

After determining the overdrive lookup table corresponding to the target adjustment area, obtain scale factors corresponding to each of the other areas except the target adjustment area, so as to obtain the overdrive lookup table of the display panel by the overdrive lookup table and each scale factor, specifically, referring to FIG. 5, that is, S40 includes:

S41, determining the scale factors corresponding to each of the other areas except the target adjustment area on the display panel;

S42, multiplying each grayscale difference value in the overdrive lookup table of the target adjustment area by the scale factor corresponding to each of the other areas to obtain the overdrive lookup table corresponding to each of the other areas;

S42, establishing the overdrive lookup table of the display panel according to the overdrive lookup table of the target adjustment area and the overdrive lookup table corresponding to each of the other areas.

The optical characteristics corresponding to each area on the display panel have a certain regularity, and the optical characteristic scale factor corresponding to each of the other areas could be obtained according to the regularity. The target reference area does not need to compensate for the driving voltage, so the scale factor is zero, while the scale factor corresponding to the target adjustment area is 1, according to the optical characteristics regularity corresponding to each area, the scale factor of the target adjustment area and the scale factor of the target reference area, scale factor of each of the other areas are obtained, the closer the distance between the area on the display panel and gate integrated circuit, the smaller the scale factor corresponding to the area; afterwards multiply each grayscale difference value in the overdrive lookup table corresponding to the target adjustment area by the scale factor corresponding to each of the other areas, then the overdrive lookup table corresponding to each of the other areas is obtained; and the overdrive lookup table corresponding to target adjustment area and each of the other areas are integrated to obtain the overdrive lookup table of the display panel.

It should be noted that the overdrive lookup table of the display panel includes an overdrive lookup table corresponding to first illuminating the R sub-pixels and then illuminating the G sub-pixels, an overdrive lookup table corresponding to first illuminating the B sub-pixels and then illuminating the R sub-pixels and an overdrive lookup table corresponding to first illuminating the G sub-pixels and then illuminating the B sub-pixels.

In this technical solution provided by the embodiment, the target reference area and the target adjustment area in the display panel are determined, so as to measure the reference color coordinate matrix corresponding to the target reference area, and the adjustment color coordinate matrix corresponding to the target adjustment area, thus the overdrive lookup table corresponding to the target adjustment area is determined according to the adjustment color coordinate matrix and the reference color coordinate matrix, and then the overdrive lookup table corresponding to the display panel is established according to the overdrive lookup table corresponding to the target adjustment area; since the overdrive lookup table corresponding to the entire display panel could be established as long as the overdrive lookup table corresponding to the target adjustment area is determined, which greatly reduces the time for establishing overdrive lookup table of display panel, saves labor and material resources, and decreases the cost for establishing overdrive lookup table of the display panel.

The present disclosure also provides a display panel, the display panel includes at least one processor, and a memory, wherein, The memory stores computer executable instructions that could be executed by the at least one processor, when the computer executable instructions are executed by the at least one processor, the following steps are performed by one processor:

Determining a target reference area and a target adjustment area in the display panel;

Measuring a reference color coordinate matrix corresponding to the target reference area, and an adjustment color coordinate matrix corresponding to the target adjustment area;

Determining an overdrive lookup table corresponding to the target adjustment area according to the adjustment color coordinate matrix and the reference color coordinate matrix; and Establishing an overdrive lookup table corresponding to the display panel according to the overdrive lookup table corresponding to the target adjustment area.

The present disclosure also provides a readable storage medium, the readable storage medium stores computer executable instructions that could be executed by at least one processor, when the computer executable instructions are executed by the at least one processor, the following steps are performed by one processor:

Determining a target reference area and a target adjustment area in the display panel;

Measuring a reference color coordinate matrix corresponding to the target reference area, and an adjustment color coordinate matrix corresponding to the target adjustment area;

Determining an overdrive lookup table corresponding to the target adjustment area according to the adjustment color coordinate matrix and the reference color coordinate matrix; and Establishing an overdrive lookup table corresponding to the display panel according to the overdrive lookup table corresponding to the target adjustment area.

Sequence numbers of the embodiments disclosed herein are meant for the sole purpose of illustrative and do not represent the advantages and disadvantages of these embodiments.

It should be noted that, throughout this disclosure, the terms "include", "comprise" or any other variations thereof are intended to encompass non-exclusive inclusions, so that a process, method, article, or system that includes a series of elements would include not only those elements, but it may further include other elements that are not explicitly listed or elements that are inherent to such processes, methods, articles, or systems. In the absence of extra limitations, an element defined by the phrase "includes a . . . " does not exclude the presence of additional identical elements in this process, method, article, or system that includes the element.

Through the above description of the foregoing embodiments, those skilled in the art can clearly understand that the above methods of the embodiments can be implemented by means of software plus a necessary general hardware platform; they certainly can also be implemented by means of hardware, but in many cases, the former is a better implementation. Based on this understanding, the essential part of the technical solution according to the present disclosure or the part that contributes to the prior art can be embodied in the form of a software product. Computer software products can be stored in a storage medium as described above (e.g., ROM/RAM, a magnetic disk, an optical disc) which includes instructions to cause a terminal device (e.g., a mobile phone, a computer, a server, an air conditioner, or a network device, etc.) to perform the methods described in the various embodiments of the present disclosure.

The foregoing description portrays merely some illustrative embodiments of the present disclosure, and is not intended to limit the patentable scope of the present disclosure. Any equivalent structural or flow transformations based on the specification and the drawing of the present disclosure, or any direct or indirect applications of the present disclosure in other related technical fields, shall all fall within the protection scope of the present disclosure.

What is claimed is:

1. A method of establishing overdrive lookup table for display panel, wherein, the method comprises:

determining a target reference area and a target adjustment area in the display panel;

measuring a reference color coordinate matrix corresponding to the target reference area, and an adjustment color coordinate matrix corresponding to the target adjustment area;

determining an overdrive lookup table corresponding to the target adjustment area according to the adjustment color coordinate matrix and the reference color coordinate matrix; and establishing an overdrive lookup table corresponding to the display panel according to the overdrive lookup table corresponding to the target adjustment area;

wherein, the operation of measuring the reference color coordinate matrix corresponding to the target reference area, and the adjustment color coordinate matrix corresponding to the target adjustment area comprises:

illuminating adjacent sub-pixels connected with data line of each preset serial number in the target reference area in sequence according to different grayscale values, so as to measure color coordinate corresponding to the target reference area, to obtain the reference color coordinate matrix, wherein, the preset serial numbers are 3n+1, 3n+2, or 3n+3, n is an integer; and illuminating adjacent sub-pixels connected with data line of each preset serial number in the target adjustment area in sequence according to different grayscale values, so as to measure color coordinates corresponding to the target adjustment area, to obtain the adjustment color coordinate matrix.

2. The method of claim 1, wherein, the operation of determining the overdrive lookup table corresponding to the target adjustment area according to the adjustment color coordinate matrix and the reference color coordinate matrix comprises:

selecting a target reference color coordinate in the reference color coordinate matrix in sequence;

obtaining a first former illuminating grayscale value and a first latter illuminating grayscale value of the target reference color coordinate at each time the target reference color coordinate is extracted;

obtaining a target adjustment color coordinate matching with the first former illuminating grayscale value and the target reference color coordinate in the adjustment color coordinate matrix, wherein, the target adjustment color coordinate is in the area corresponding to the first former illuminating grayscale value and matches with the target reference color coordinate;

calculating a grayscale difference value between the first latter illuminating grayscale value and a second latter illuminating grayscale value corresponding to the target adjustment color coordinate;

determining a position of each grayscale difference value in a preset table according to the first former illuminating grayscale value and the first latter illuminating grayscale value corresponding to each target reference color coordinate, so as to fill each grayscale difference value in the preset table, and obtain the overdrive lookup table corresponding to the target adjustment area.

3. The method of claim 2, wherein, the operation of establishing the overdrive lookup table corresponding to the display panel according to the overdrive lookup table corresponding to the target adjustment area comprises:

obtaining scale factors corresponding to each of the other areas except the target adjustment area, so as to determine the overdrive lookup table of the display panel according to the overdrive lookup table corresponding to the target adjustment area and each scale factor.

4. The method of claim 3, wherein, the operation of obtaining the scale factors corresponding to each of the other areas except the target adjustment area, so as to determine the overdrive lookup table of the display panel according to the overdrive lookup table corresponding to the target adjustment area and each scale factor, comprises:

determining the scale factors corresponding to each of the other areas except the target adjustment area on the display panel;

multiplying each grayscale difference value in the overdrive lookup table of the target adjustment area by the scale factor corresponding to each of the other areas to obtain the overdrive lookup table corresponding to each of the other areas; and establishing the overdrive lookup table of the display panel according to the overdrive lookup table of the target adjustment area and the overdrive lookup table corresponding to each of the other areas.

5. The method of claim 2, wherein, the operation of obtaining the target adjustment color coordinate matching with the first former illuminating grayscale value and the target reference color coordinate in the adjustment color coordinate matrix comprises:

determining the adjustment color coordinate in the adjustment color coordinate matrix closest to the color of the target reference color coordinate, as the target adjustment color coordinate matching with the target reference color coordinate.

6. The method of claim 2, wherein, the number of the first former illuminating grayscale values is 17, the number of the first latter illuminating grayscale values is 17, the number of the second former illuminating grayscale values is 17, and the number of second latter illuminating grayscale values is 256.

7. The method of claim 1, wherein, subsequent to the operation of establishing the overdrive lookup table corresponding to the display panel, the method further comprises:

increasing or decreasing driving voltage corresponding to each sub-pixel in the display panel according to the overdrive lookup table of the display panel, allowing the image displayed by the display panel to be uniform.

8. The method of claim 1, wherein, the closer the distance between the area on the display panel and gate integrated circuit, the smaller the scale factor corresponding to the area.

9. The method of claim 1, wherein, the target reference area is a central area of the display panel, and the target reference area corresponds to a scale factor of zero.

10. The method of claim 1, wherein, the overdrive lookup table of the display panel comprises an overdrive lookup table corresponding to first illuminating red sub-pixels and then illuminating yellow sub-pixels, an overdrive lookup table corresponding to first illuminating blue sub-pixels and then illuminating red sub-pixels, and an overdrive lookup table corresponding to first illuminating yellow sub-pixels and then illuminating blue sub-pixels.

11. The method of claim 1, wherein, the overdrive lookup table of the display panel is a 17*17 lookup table.

12. The method of claim 1, wherein, thin film transistor array substrate in the display panel has a dual gate driving structure, and data lines of the thin film transistor array substrate are connected with adjacent sub-pixels in the same row.

13. A display panel, wherein, the display panel comprises at least one processor, and a memory, wherein, the memory stores computer executable instructions that could be executed by the at least one processor, when the computer executable instructions are executed by the at least one processor, the following steps are performed by one processor:

determining a target reference area and a target adjustment area in the display panel;

measuring a reference color coordinate matrix corresponding to the target reference area, and an adjustment color coordinate matrix corresponding to the target adjustment area;

determining an overdrive lookup table corresponding to the target adjustment area according to the adjustment color coordinate matrix and the reference color coordinate matrix; and establishing an overdrive lookup table corresponding to the display panel according to the overdrive lookup table corresponding to the target adjustment area;

wherein, the operation of measuring the reference color coordinate matrix corresponding to the target reference area, and the adjustment color coordinate matrix corresponding to the target adjustment area comprises:

illuminating adjacent sub-pixels connected with data line of each preset serial number in the target reference area in sequence according to different grayscale values, so as to measure color coordinate corresponding to the target reference area, to obtain the reference color coordinate matrix, wherein, the preset serial numbers are 3n+1, 3n+2, or 3n+3, n is an integer; and illuminating adjacent sub-pixels connected with data line of each preset serial number in the target adjustment area in sequence according to different grayscale values, so as to measure color coordinates corresponding to the target adjustment area, to obtain the adjustment color coordinate matrix.

14. The display panel of claim 13, wherein, when the computer executable instructions are executed by the at least one processor, the following steps are performed by one processor:

selecting a target reference color coordinate in the reference color coordinate matrix in sequence;

obtaining a first former illuminating grayscale value and a first latter illuminating grayscale value of the target reference color coordinate at each time the target reference color coordinate is extracted;

obtaining a target adjustment color coordinate matching with the first former illuminating grayscale value and the target reference color coordinate in the adjustment color coordinate matrix, wherein, the target adjustment color coordinate is in the area corresponding to the first former illuminating grayscale value and matches with the target reference color coordinate;

calculating a grayscale difference value between the first latter illuminating grayscale value and a second latter illuminating grayscale value corresponding to the target adjustment color coordinate;

determining a position of each grayscale difference value in a preset table according to the first former illuminating grayscale value and the first latter illuminating grayscale value corresponding to each target reference color coordinate, so as to fill each grayscale difference value in the preset table, and obtain the overdrive lookup table corresponding to the target adjustment area.

15. The display panel of claim 14, wherein, when the computer executable instructions are executed by the at least one processor, the following steps are performed by one processor:

obtaining scale factors corresponding to each of the other areas except the target adjustment area, so as to determine the overdrive lookup table of the display panel according to the overdrive lookup table corresponding to the target adjustment area and each scale factor.

16. The display panel of claim 15, wherein, when the computer executable instructions are executed by the at least one processor, the following steps are performed by one processor:

determining the scale factors corresponding to each of the other areas except the target adjustment area on the display panel;

multiplying each grayscale difference value in the overdrive lookup table of the target adjustment area by the scale factor corresponding to each of the other areas to obtain the overdrive lookup table corresponding to each of the other areas; and establishing the overdrive lookup table of the display panel according to the overdrive lookup table of the target adjustment area and the overdrive lookup table corresponding to each of the other areas.

17. The display panel of claim 13, wherein, when the computer executable instructions are executed by the at least one processor, the following steps are performed by one processor: determining the adjustment color coordinate in the adjustment color coordinate matrix closest to the color of the target reference color coordinate, as the target adjustment color coordinate matching with the target reference color coordinate.

18. A readable storage medium, wherein, the readable storage medium stores computer executable instructions that could be executed by at least one processor, when the computer executable instructions are executed by the at least one processor, the following steps are performed by one processor:

determining a target reference area and a target adjustment area in the display panel;

measuring a reference color coordinate matrix corresponding to the target reference area, and an adjustment color coordinate matrix corresponding to the target adjustment area;

determining an overdrive lookup table corresponding to the target adjustment area according to the adjustment color coordinate matrix and the reference color coordinate matrix; and establishing an overdrive lookup table corresponding to the display panel according to the overdrive lookup table corresponding to the target adjustment area;

wherein, the operation of measuring the reference color coordinate matrix corresponding to the target reference area, and the adjustment color coordinate matrix corresponding to the target adjustment area comprises:

illuminating adjacent sub-pixels connected with data line of each preset serial number in the target reference area in sequence according to different grayscale values, so as to measure color coordinate corresponding to the target reference area, to obtain the reference color coordinate matrix, wherein, the preset serial numbers are 3n+1, 3n+2, or 3n+3, n is an integer; and illuminating adjacent sub-pixels connected with data line of each preset serial number in the target adjustment area in sequence according to different grayscale values, so as to measure color coordinates corresponding to the target adjustment area, to obtain the adjustment color coordinate matrix.

* * * * *